US007058570B1

(12) United States Patent
Yu et al.

(10) Patent No.: US 7,058,570 B1
(45) Date of Patent: Jun. 6, 2006

(54) COMPUTER-IMPLEMENTED METHOD AND APPARATUS FOR AUDIO DATA HIDING

(75) Inventors: Hong Heather Yu, Plainsboro, NJ (US); Xin Li, Princeton, NJ (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/499,525

(22) Filed: Feb. 10, 2000

(51) Int. Cl.
*G10L 19/04* (2006.01)

(52) U.S. Cl. ..... 704/219

(58) Field of Classification Search ..... 704/270, 704/221, 222, 219, 258; 382/100; 713/176
See application file for complete search history.

(56) References Cited

U.S. PATENT DOCUMENTS

| | | | | |
|---|---|---|---|---|
| 5,355,416 | A | 10/1994 | Sacks | |
| 5,621,772 | A | 4/1997 | Maturi et al. | |
| 5,848,155 | A | 12/1998 | Cox | |
| 5,889,868 | A | 3/1999 | Moskowitz et al. | |
| 5,893,067 | A | 4/1999 | Bender et al. | |
| 6,233,347 | B1 * | 5/2001 | Chen et al. | 382/100 |
| 6,278,791 | B1 * | 8/2001 | Honsinger et al. | 382/100 |
| 6,442,283 | B1 * | 8/2002 | Tewfik et al. | 382/100 |
| 6,480,825 | B1 * | 11/2002 | Sharma et al. | 704/270 |
| 6,678,389 | B1 * | 1/2004 | Sun et al. | 382/100 |
| 6,834,344 | B1 * | 12/2004 | Aggarwal et al. | 713/176 |

OTHER PUBLICATIONS

Kim, Won-Gyum et al., "An Audio Watermarking Scheme Robust to MPEG Audio Compression" Proceedings of the IEEE-Eurasip Workshop on Nonlinear Signal and Image Processing, vol. 1, 1999, pp. 326-330, XP000979677, no month found.

Sang-Kwang Lee et al., "Digital Audio Watermarking in the Cepstrum Domain" International Conference on Consumer Electronics. Digest of Technical Papers, Jun. 2000, pp. 334-335, XP000952156.

(Continued)

*Primary Examiner*—Wayne Young
*Assistant Examiner*—Jakieda R. Jackson
(74) *Attorney, Agent, or Firm*—Harness, Dickey & Pierce, PLC

(57) ABSTRACT

A computer-implemented method and apparatus for embedding hidden data in an audio signal. An audio signal is received in a base domain and then transformed into a non-base domain, such as cepstrum domain or LP residue domain. The statistical mean manipulation is employed on selected transform coefficients to embed hidden data. The introduced distortion is controlled by psychoacoustic model to ensure the imperceptibility of the embedded hidden data. Scrambling techniques can be plugged in to further increase the security of the data hiding system. The present new audio data hiding scheme provides transparent audio quality, sufficient embedding capacity, and high survivability over a wide range of common signal processing attacks.

23 Claims, 5 Drawing Sheets

OTHER PUBLICATIONS

Petrovic R. et al., "Data Hiding Within Audio Signals", 4th International Conference on Telecommunications in Modern Satellite, Cable adn Broadcasting Services. Telsiks '99 (Cat. No. 99Ex365), vol. 1, Oct. 13-15, 1999, pp. 88-95, XP 002212098, IEEE, Piscataway, NJ, USA.

Xin Li et al., "Transparent and Robust Audio Data Hiding in Cepstrum Domain", 2000 IEEE International Conference on Multipmedia and Expo. ICME2000. Proceedings. Latest Advances in the Fast changing World of Multimedia (Cat. No. 00TH8532), New York, NY USA, vol. 1, Jul. 30, 2000, pp. 397-400, XP002212099.

* cited by examiner

COMPUTER-IMPLEMENTED METHOD AND APPARATUS FOR AUDIO DATA HIDING

BACKGROUND OF THE INVENTION

1. Technical Field

The present invention relates generally to computer-implemented data hiding, and more particularly, to computer-implemented audio data hiding.

2. Background and Summary of the Invention

Electronic media distribution imposes high demand on content protection mechanisms for secure distribution of media. Imperceptible data hiding for copy control and copyright protection of digital media is gradually gaining widespread attention due mainly to the prominence of electronic media distribution via the Internet.

In particular, the ease with which digital data can be transmitted over the Internet, and the fact that unlimited perfect copies of the original can be made and distributed, are the major causes of concern for intellectual property rights management. Copyright protection and playback/record control need to be addressed so that content owners will agree to electronic distribution of digital media. The problem is amplified by the fact that digital copy technology, such as DVD-RAM, CD-R, CD-RW, and DTV, and high quality compression and digital multimedia signal processing software are widely available. For example, the availability of MP3 compression (MPEG-I layer-3 audio coding standard) makes CD (compact disc) quality music available to users through downloads from unauthorized web sites on the Internet.

Previous approaches of data hiding in audio media have concentrated on embedding hidden data in the base domain (original time domain). These approaches lend themselves to attacks and distortions on the synchronization structure of the audio signal. Such kind of attacks and distortions (for example, time-scale warping and pitch-shift warping attacks) can substantially change the structure of audio signal in the time domain but with little affect on the audio quality. Thus, they are commonly seen as the most challenging problems in audio data hiding.

The present invention aims at overcoming the aforementioned disadvantages. The present invention embeds the hidden data in the transform domain, preferably, cepstrum or Linear Prediction residue domain. In accordance with the teachings of the present invention is a computer-implemented method and apparatus for embedding hidden data in an audio signal. An audio signal is received in a base domain. The received audio signal is transformed to a non-base domain. The hidden data is embedded in the transformed non-base domain audio signal. The transform-domain representation can be shown to be more robust to severe synchronization destructive attacks than base domain representation. For instance, perceptually important features of an audio signal, such as pitch or vocal track, can be well parameterized in certain transform domain. Common signal processing attacks seldom modify those features unless paying the penalty on the transparency requirement, i.e., introducing significant degradation on the audio perceptual quality.

In transform domain, the present invention employs Statistical Mean Manipulation embedding strategy. This is based on the observation that statistical mean of selected transform coefficients typically experience small variation after most common signal processing. Hidden data, in binary format, is embedded into the audio on a frame-by-frame basis by manipulating the statistical mean. A positive mean (larger than certain preset threshold) is enforced to carry bit "1". The introduced distortion is controlled by psychoacoustic model to meet transparency requirements. In addition, the security level of the scheme can be further increased via a scrambling technique on the transform coefficients with the scrambling filter kept as a secret key by the content owner. With these novel techniques, the present invention maximizes the survivability of embedded data under the condition of meeting the requirement of transparency (which is that the embedded data should not introduce any significant audible distortion).

BRIEF DESCRIPTION OF THE DRAWINGS

Additional advantages and features will become apparent from the subsequent description and the appended claims taken in conjunction with the accompanying drawings wherein the same referenced numeral indicates the same components:

FIG. 8 is a graph containing an unit circle illustrative of N poles being randomly distributed thereon for use as a scrambling technique in the present invention.

DETAILED DESCRIPTION OF THE PREFERRED EMBODIMENT

Figure 1:
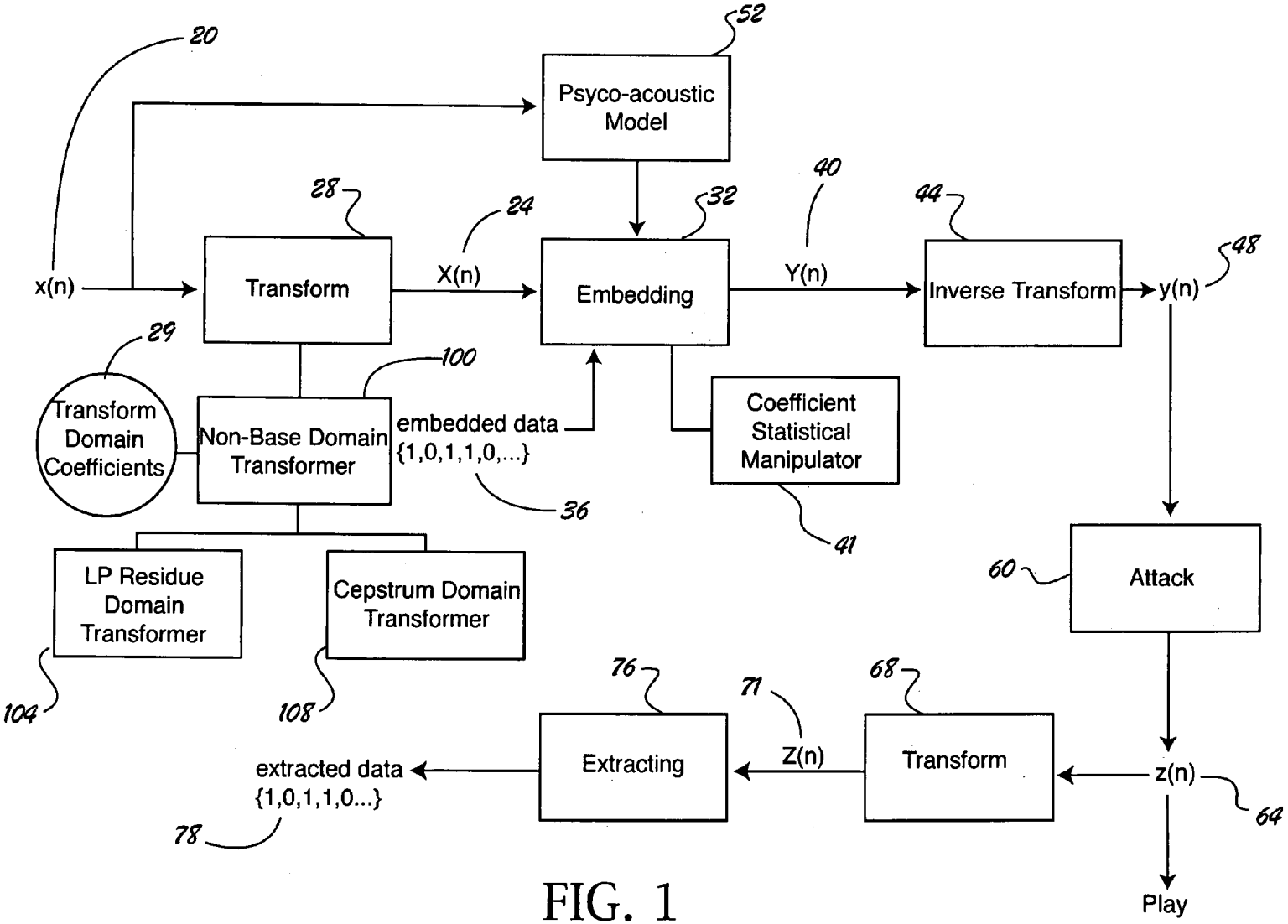
FIG. 1 is a block diagram depicting the audio data hiding system of the present invention.

The system of the present invention for hiding secondary data in an audio signal is shown in FIG. 1. Audio signal x(n) 20 is received through an input device in time domain and is mapped to an equivalent representation in transform domain X(n) 24 via transformer process 28. Transformer process 28 generates transform domain coefficients 29 that characterize signal X(n). Data embedder module 32 embeds hidden data 36 (such as identification data) in signal X(n) 24 in transform domain to generate Y(n) signal 40. Preferably data embedder 32 utilizes a coefficient manipulator module 41 to manipulate the transform domain coefficients to embed the data.

Y(n) signal 40 is mapped back to the time domain via inverse transform process 44 to recover marked audio signal y(n) 48. A psycho-acoustic model 52 in transform domain is employed to control the inaudibility of embedded data, so that perceptually y(n) signal 48 does not significantly differ from x(n) signal 20. After possible attacks as denoted by block 60, signal z(n) 64 is played so as to hear the audio signal. Signal z(n) 64 may be heard at a remote computer having been transmitted across a global communication network, such as the Internet. To extract the hidden data in signal z(n) 64, signal z(n) 64 is mapped via transform block 68 to transform domain signal Z(n) 71 for data extraction via process 76. Extracting process 76 essentially reverses the embedding process of block 32 in order to generate extracted data 78 from signal Z(n) 71.

In particular, the present invention utilizes a novel approach to audio dating hiding through its use in part of a transform domain. The transform domain coefficients (generated through a non-base transform domain and which are features for example in cepstrum domain) are more robust to various attacks. For example, a jittering attack might significantly change the synchronization structure of audio in the time domain, but its transform domain representation experiences much less disturbance. Accordingly, the present invention includes, but is not limited to, for its audio data hiding scheme the following components: parametric representation, data embedding strategy, and psychoacoustic model.

Transform Domain

In the preferred embodiment transform processes 28 and 68 utilize a non-base domain transformer process 100. Certain transform domain representations can provide an equivalent, but often a more canonical representation of the audio signal. For example, Cepstral analysis on audio signal clearly separates out the vocal tract information from the excitation information and frequency domain representation contains exactly the same audio information with physical meaning at different frequency. The choice of representation depends on the specific application and problem formulation. In the data hiding scenario, the present invention targets at the transform domain as much "attack-invariant" as possible, that is, after common signal processing or even intentional attacks, the transform domain representation experiences much less variance than the original time domain. The preferred embodiment of the present invention generates transform domain coefficients that can be divided into two cases: Linear prediction residue domain processing 104 and cepstrum domain processing 108.

LP Residue Domain

Figures 2A, 2B, 2C:
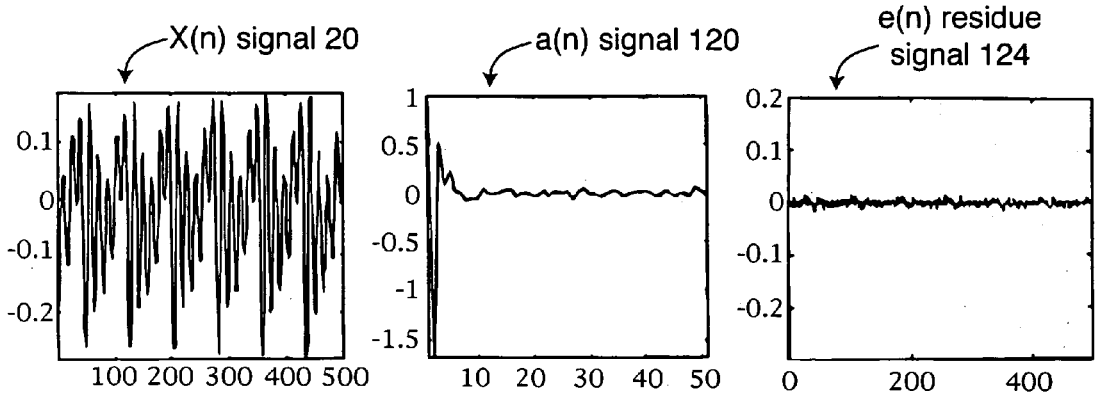
FIGS. 2*a*–2*c* depict graphs illustrative of processing an audio signal using the linear prediction residue domain technique of the present invention.

Linear prediction analysis 104 represents the signal x(n) 20 as a linear convolution of two parts: All-Role (AR) filter a(n) and residue sequence e(n). AR filter a(n) contains most information about the envelope of x(n) and residue e(n) contains information about its fine structure. FIGS. 2*a*–2*c* show an example of linear prediction analysis with an exemplary order N=50 for a segment of voiced signal. FIG. 2*a* depicts an exemplary graph of an original audio signal X(n) 20. FIG. 2*b* depicts an exemplary graph of the original audio signal X(n) 20 of FIG. 2*a* after an AR filter a(n) has been applied. The resulting signal is shown by reference numeral 120. FIG. 2*c* depicts a graph of the residue signal e(n) 124 of the original audio signal X(n) 20 of FIG. 2*a*. Even after attacks on signal x(n), signals a(n) and e(n) experience little disturbance as long as audio quality of x(n) is kept. Therefore both a(n) and e(n) can be utilized by the present invention for the data-hiding domain.

In the preferred embodiment, residue domain is selected instead of a(n) for the following reasons: 1) e(n) has the same dimension as original signal x(n) while a(n) typically has the same dimension as prediction order. Larger dimensionality is more suitable for data-hiding purpose; 2) a(n) is perceptually more important and allows much less disturbance than e(n). Moreover, LP synthesis and LP analysis both depend on a(n). As long as a(n) has been distorted, the transform is not linear any more and it typically becomes difficult to recover a(n) at the decoder.

Cepstrum Domain

Figure 3:
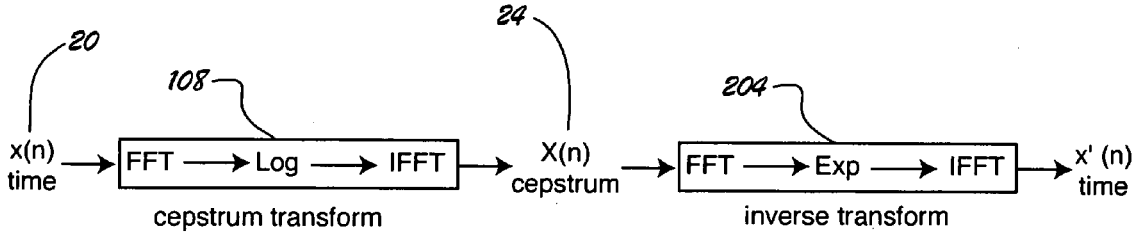
FIG. 3 is a block flow diagram illustrative of using the cepstrum domain in order to process an audio data signal.
Figure 4A:
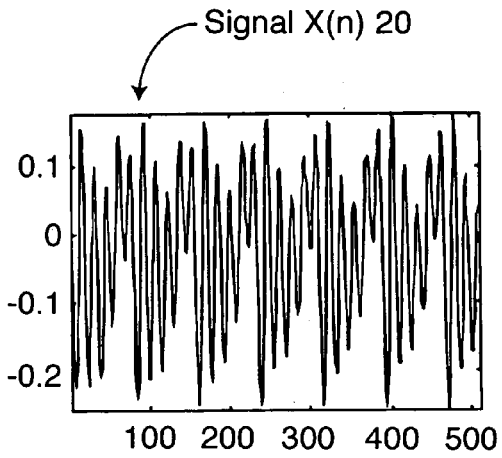
FIGS. 4*a*–4*d* are x-y graphs depicting the cepstrum representation for a segment of voiced signal.
Figure 4B:
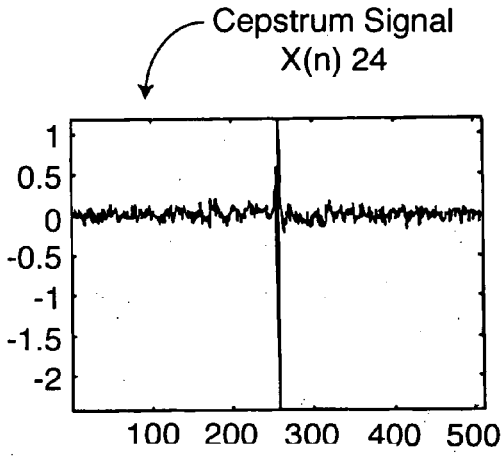
Figure 4C:
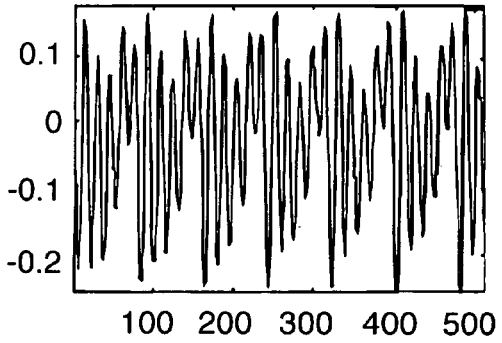
Figure 4D:
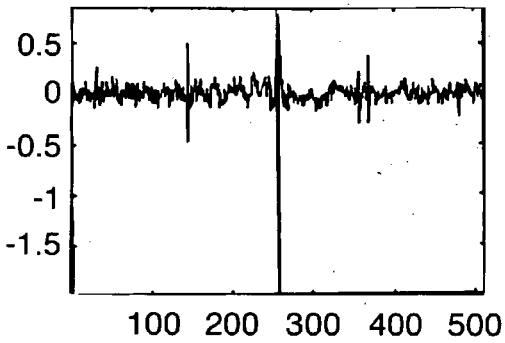

Cepstral analysis separates out the vocal tract information from the excitation information and frequency components that contain physical spectral characteristics of sound. Cepstrum domain transformer 108 and its inverse process 204 are shown in FIG. 3, each consisting of three linear operations. The linear operation of cepstrum domain transformer 108 includes a fast Fourier transform (FFT) of signal x(n) 20, then a logarithm operation, then an inverse FFT. The result of cepstrum domain transformer 108 is signal X(n) 24 in a cepstrum domain. The linear operation of inverse cepstrum transformer 204 is a FFT, an exponential operation, and an inverse FFT of signal X(n) 24. The result of inverse cepstrum transformer 204 is x'(n) in the time domain. Preferably, the present invention utilizes the real part of the complex cepstrum.

An aspect of cepstral analysis is that the logarithm changes the production in frequency domain (convolution in time domain) into the sum of log-frequency domain. Therefore it imposes upon the system a linearized structure. FIGS. 4*a*–4*d* show the cepstrum representation for a segment of voiced signal. More specifically, FIGS. 4*a*–4*d* depict the recorded real part of complex cepstrum X(n). It should be noted that around the center, large cepstrum coefficients contain important information on the envelope of x(n); while on two sides small ones contain finer structures. From FIGS. 4*c* and 4*d*, it is observed that they mostly experience small disturbance after serious attack in time domain (e.g., 1% jittering).

Data Embedding Strategy

The present invention uses a novel data-embedding strategy in combination with the transform domain process and other aspects of the present invention. The present invention utilizes the transform domain coefficients in order to embed the data. The embedding is preferably based on modulating an embedded bit with the statistical mean of selected features. For instance, in cepstrum domain embedding, by enforcing a positive mean, an "1" is embedded and a zero mean is left untouched if a "0" is embedded.

Note that selected features often observe an uni-modal distribution whose mean is or is nearly zero. If the mean $m_I$ is not exactly zero, a procedure, $I_I=I_I-m_I$, removes the biased mean without affecting the audio quality.

Statistical mean manipulation technique can be viewed as one type of modulation scheme based on statistical mean of selected features. As mentioned above, such mean is typically around zero without modulation. Therefore, by enforcing the statistical mean to be a pre-set value, extra information is carried to the decoder. (Note though, for data hiding purpose, the value has to be small enough such that there will be no audible artifacts after the modulation.)

For example, the present invention's binary modulation scheme works as follows:

$$H_1\text{: enforce } E\{X_I\}=T$$

$$H_0\text{: enforce } E\{X_I\}=T$$

Where E $\{X_I\}$ denotes the expectation of $X_I$ and T>0 us a pre-set value.

Figure 5:
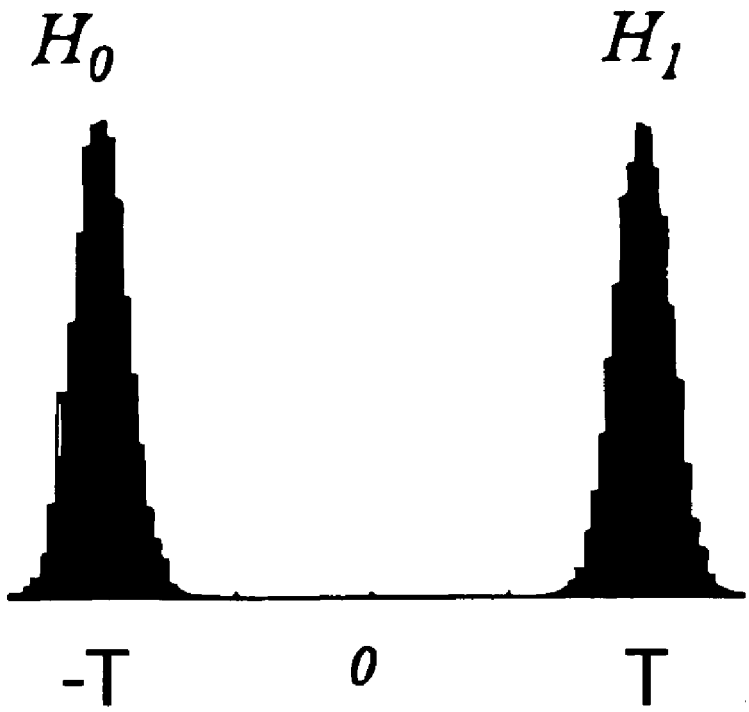
FIG. 5 is a graph depicting an exemplary binary modulation.

At the decoder, by computing statistical mean of $X_I$, the embedded data value, "0" or "1", is decoded. Note that for higher precision, it is often desirable to separate region T and −T in FIG. 5 as much as possible, i.e., to keep as less overlapping region as possible. Other modulation schemes are possible. For example, in conventional spread spectrum scheme, the modulation is done by inserting a pseudorandom sequence as a signature into the host signal and the existence of the signature carries one bit information. Compared to the conventional spread spectrum correlation-based detection strategy, the present invention has less strict assumption on the statistical behavior of distortion introduced in attacks. It assumes the introduced distortion has zero mean while correlation-based approach often requires alignment between the signature and the host signal, which is not always satisfied in practice. Experimental results for the present invention has shown superior robustness in terms of surviving a wide range of attacks including time-scale warping and pitch-shift warping.

The following sections discuss in detail the present invention's embedding in two transform domain, LP-residue domain and cepstrum domain.

Embedding in the LP (Linear Prediction) Residue Domain

Figure 6A:
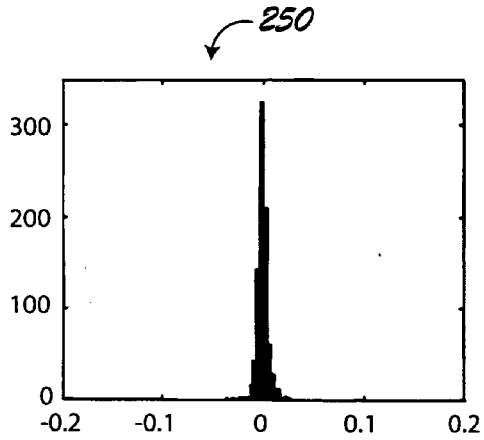
FIGS. 6*a*–6*b* are x-y graphs illustrative of the embedding process using the linear prediction residue domain technique of the present invention.
Figure 6B:
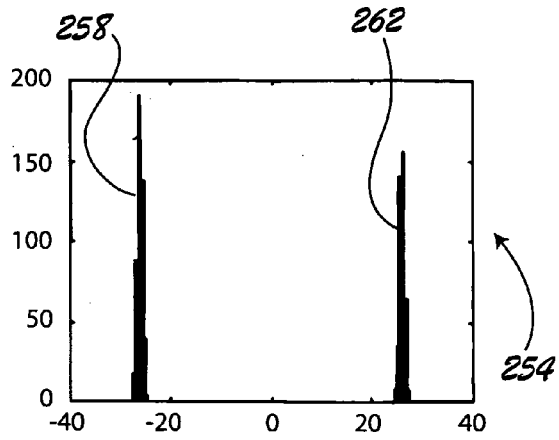

The signal e(n) is used to denote the residue signal after LP analysis. With reference to FIGS. 6*a* and 6*b*, when prediction order is large enough, e(n) is very close to white noise and therefore can often be modeled by a zero-mean unimodal probability function. To embed one bit into e(n), e(n) is manipulated as following.

To embed "1": e'(n)=e(n)+th, if e(n)≦0; To embed "0": e'(n)=e(n)−th, if e(n)≦0 where th is a positive number, controlling the magnitude of introduced distortion which is determined by psychoacoustic analysis. One-pass manipulation may not guarantee that the residue generated at the decoder observes the same distribution as that at the decoder. Therefore iterative manipulation is preferably employed to assure the convergence. K=3 iterations is typically sufficient to obtain converged solution.

After the above manipulation, the statistical mean of e(n) may deviate from the origin and its sign denotes the embedded bit. FIGS. 6*a* and 6*b* show the effect of the above manipulation on histogram of statistical mean of e(n). Original unimodal distribution 250 of FIG. 8*a* has been separated into a bimodal one 254 of FIG. 7*b*: one peak 258 centered in left half plane and one peak 262 centered in right half plane. Therefore by choosing the threshold to be zero, it is determined which bit has been embedded at the decoder. The above bimodal distribution of testing statistics (here it is the statistical mean) is very robust to common signal processing.

Embedding in the Cepstrum Domain

Figure 7A:
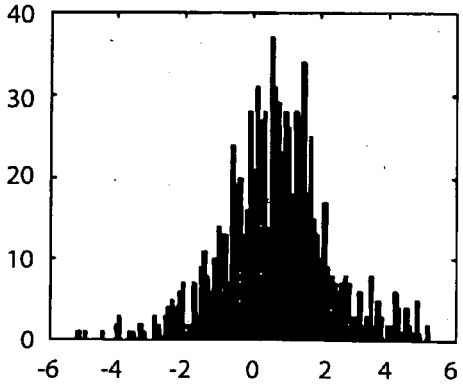
FIGS. 7*a*–7*b* are x-y graphs illustrative of the embedding process using the cepstrum domain technique of the present invention.
Figure 7B:
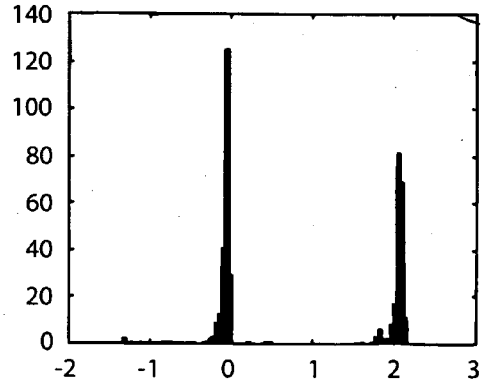
Figure 7C:
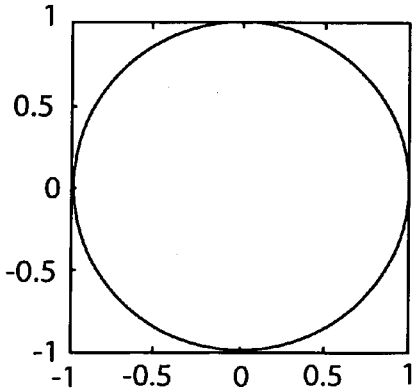

In the cepstrum domain transformation embodiment of the present invention, the statistical mean of the cepstrum coefficients away from the center(|i−N/2|>d) can be modeled by a zero-mean unimodal probability function. Similarly, its mean is manipulated to hide additional information. However, through experiments it is found that cepstral representation has an asymmetric property: negative mean often experiences much larger variance than positive mean after some type of signal processing, i.e., a positive mean is much more robust than a negative mean. Therefore, the above mean-manipulation is preferably supplemented as following:

To embed "1": $e'(n)=e(n)+th$, if $e(n)$ . . . 0; To embed "0": $e'(n)=e(n)$ where th is again a positive number, controlled by psychoacoustic model. The present invention preferably avoids enforcing negative mean and uses positive mean to denote the existence of the mark. The histogram of the statistical mean before data hiding is shown in FIG. 7*a*, and FIG. 7*b* shows the histogram after the data hiding. Similarly, bimodal distribution of testing statistics enables correct detection of embedded bit. It should be understood that the present invention is not limited to only manipulating a statistical mean, but includes manipulating other statistical measures (e.g., standard deviation).

Scrambling Strategy

An intentional attacker might be able to use a similar mean manipulation strategy to remove/modify embedded data. To fight against such a situation, a scrambling technique can be used to increase its security. A scrambling filter is chosen by the owner and kept as secret. With reference to FIG. 8, length-N scrambling filter f(n) is an all-pass filter with N poles randomly distributed on the unit circle. Scrambling/Descrambling operations are defined as:

| | | |
|---|---|---|
| y = ifft(fft(x).*f)<br>scrambling | ↔ | x = ifft(fft(y).*conj(f))<br>descrambling |

Since the "key" controlled scrambling filter is kept away from the attacker, it becomes difficult to attack the above scheme. Meanwhile, testing results indicate scrambling also shows the advantage of producing more favorable audio quality for LP residue domain approach.

Psychoacoustic Model

The introduced distortion is directly controlled by a scaling factor. To keep the embedded signature inaudible, a psychoacoustic model controls the shifting factor th. Psychoacoustic model in frequency domain has been previously studied and proposed. For instance, a commonly accepted good model in subband domain is specified in MPEG audio coding. In LP-residue or cepstrum domain, there still lacks systematic psychoacoustic model to control the inaudibility of introduced distortion. One way to solve this problem is to control the threshold in frequency domain or by utilizing the frequency domain model. In the present invention, intuitive models in the LP-residue domain and cepstrum domain are used. They are generated based on subjective listening tests which produce a threshold table.

As described above, the positive number th by which selected features are shifted controls the introduced distortion. The larger it is chosen, the more robust is the scheme but the more likely the introduced noise would be audible. In order to assure the marked audio is perceptually no different from the original one, the present invention employs a psychoacoustic model, i.e., the above-described threshold table generated via a subjective listening test to adjust th. For each frame of audio sample, th is adjusted based on the value found in the table. Based on tests on different type of audio signals, the following specific models are employed:

1) LP Residue Domain

When both scrambling and iteration is involved, th is chosen to be:

$$th=\max(\text{const}, \text{var}(e))$$

where the constant is in the range of 0.5~1e−4 and the term "e" represents the LP residue signal with "var" representing the function of standard deviation. Noisy music like rock-and-roll typically has a larger constant than peaceful ones.

2) Cepstrum Domain

Cepstrum coefficients corresponding to different character of audio signal have different allowed distortion. Typically those around the center (large ones) can bear larger distortion than those away from the center:

$th$=1~2e−3 for small cepstrum coefficients; 1~2e−2 for large ones.

Of course, the above choices are merely exemplary for the non-limiting example above. The examples above depict audio data hiding at the capacity region of 20~40 bps (audio is sampled at 44,100 Hz and digitized with 16 bits). If lower embedding capacity is enough, then the present invention achieves a better tradeoff between the transparency and the capacity.

Experiment Results

1. Transparency Test

It is often difficult to quantitatively measure the perceptual quality of audio signals. However, the difference between the test signal and the original one measured by Signal-to-Noise Ratio (SNR) can partially demonstrate the energy of introduced distortion. Comparison of the SNR value between the data hiding scheme and the popular MP3 compression technique is shown in the following table.

| | MPEG-I | | | Data Hiding |
|---|---|---|---|---|
| (Kbps) | 64 | 48 | 32 | ** |
| SNR (dB) | 26.4 | 22.1 | 16.6 | 21.9 |

Specifically, the table compares the SNR of the marked audio to that of the decoded audio at different bit rates. A small test bed that includes rock n' roll as well as classical soft music gives a SNR of at least 21.9 dB for the presented system. It is generally believed that MP3 compression at 64 kbps provides transparent audio quality. Although the SNR values of presented data hiding scheme is about 4~5 dB lower than that of MP3 compression at 64 kpbs, subjective listening tests in home, office, and lab environment show the marked audio is perceptually no different from the original one.

2. Capacity

The present invention provides sufficient embedding capacity to fulfill the requirements in many practical applications. The data hiding capacity of the present invention is up to 40 bps. Considering the duration of a typical song is generally about 2~4 minutes, the present invention is able to provide up to 1,200 bytes capacity which is enough to embed a Java Applet. Therefore, the present invention has numerous applications in that it can be used in, but not limited to, playback and record control and any applications that require embedded active data.

3. Survivability

The present invention addresses the synchronization issue at the extraction stage by classifying common attacks on an audio signal into two types. Type-I attacks include MPEG-I coding/decoding, lowpass/bandpass filtering, additive/multiplicative noise, addition of echo and resampling/requantization. This type of attack typically does not significantly change the synchronization structure of audio but only globally shifts the whole sequence by some random number of samples. Type-II attacks include jittering, time-scale warping, pitch-shift warping and down/up sampling. This type of attack typically destroys the synchronization structure of the audio. Initial experiment results with the present invention have shown that the embedded data demonstrate high survivability over both types of attacks. For example, it can well survive (bit error rate is less than 1%) 64 bps MP3 compression, 8 khz low-pass filtering, addition of echoes up to 40% in volume and 0.1s in delay, 5% jittering, and time-scale warping with a factor of 0.8.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A computer-implemented method for embedding hidden data in an audio signal, comprising the steps of:

receiving the audio signal in a base domain;

transforming the received audio signal to one of a linear prediction residue domain and a cepstrum domain, wherein transformation of the received audio signal to the cepstrum domain includes a fast Fourier transform, followed by a logarithmic operation, and then an inverse fast Fourier transform; and embedding the hidden data in one of the linear prediction residue domain and the cepstrum domain via parametric representation of the audio signal by manipulating statistical mean of selected transform coefficients, and applying a scrambling technique to the transform coefficients with a scrambling filter kept as a secret key by a content owner.

2. The method of claim 1 further comprising the step of:

transforming the received audio signal to one of the linear prediction residue domain and the cepstrum domain such that transform domain coefficients are generated that are indicative of the transformed audio signal.

3. The method of claim 1 further comprising the steps of:

transforming the received audio signal to one of the linear prediction residue domain and the cepstrum domain such that transform domain coefficients are generated that are indicative of the transformed audio signal; and manipulating a statistical measure of a selected subset of the transform domain coefficients in order to embed the hidden data.

4. The method of claim 3 further comprising the step of:

modulating the embedded data with at least one predetermined statistical feature of the transformed audio signal.

5. The method of claim 3 further comprising the step of:

increasing the amplitude of at least one predetermined feature of the transformed audio signal so that statistical mean of the predetermined feature is positive for embedding a bit of one in the audio signal.

6. The method of claim 1 further comprising the step of:

using a psycho-acoustic model to control inaudibility of the embedded data.

7. The method of claim 1 further comprising the steps of:

generating an inverse transformation signal using the embedded hidden data that is in the transformed audio signal;

receiving an attack upon the generated inverse transformation signal;

transforming the attacked inverse transformation signal to a non-base domain so as to generate a second transformed audio signal that is in the non-base domain; and extracting the embedded hidden data from the second transformed audio signal.

8. The method of claim 1 further comprising the steps of:

transforming the received audio signal to the cepstrum domain;

embedding the hidden data in the cepstrum domain; and enforcing a positive mean to embed a "1" and keeping a zero mean intact to embed a "0" in the cepstrum domain.

9. The method of claim 1, wherein embedding occurs as a direct result of manipulating the statistical mean of the selected features of the audio signal with respect to a predefined mean threshold.

10. The method of claim 9, wherein embedding occurs by manipulating statistical mean of selected features, including embedding one kind of two kinds of bits by enforcing a positive mean for features selected to carry the first kind of bit, and embedding another kind of the two kinds of bits by enforcing a mean not greater than zero for features selected to carry the other kind of bit.

11. The method of claim 9, further comprising employing a procedure to remove a biased mean of selected features prior to embedding.

12. The method of claim 9, further comprising:

embedding the hidden data in the cepstrum domain; and keeping a zero mean intact to embed the other kind of bit in the cepstrum domain.

13. A computer-implemented apparatus for embedding hidden data in an audio signal, comprising the steps of:

a data input device for receiving the audio signal in a base domain;

a signal transformer connected to the data input device for transforming the received audio signal to one of a linear prediction domain and a cepstrum domain, wherein transformation of the received audio signal to the cepstrum domain includes a fast Fourier transform, followed by a logarithmic operation, and then an inverse fast Fourier transform; and an embedder connected to the signal transformer for embedding the hidden data in one of the linear prediction domain and the cepstrum domain of the audio signal by manipulating statistical mean of selected transform coefficients, and applying a scrambling technique to the transform coefficients with a scrambling filter kept as a secret key by a content owner.

14. The apparatus of claim 13 wherein the signal transformer transforms the received audio signal to the non-base domain such that transform domain coefficients are generated that are indicative of the transformed non-base domain audio signal, said embedder manipulating a statistical measure of a selected subset of the transform domain coefficients in order to embed the hidden data.

15. The apparatus of claim 13 further comprising:

a psycho-acoustic model to control inaudibility of the embedded data.

16. The apparatus of claim 13 wherein the transformer transforms the received audio signal to the cepstrum domain, said embedder embedding the hidden data in the cepstrum domain by enforcing a positive mean to embed a "1" and keeping a zero mean intact to embed a "0" in the cepstrum domain.

17. A computer-implemented method for embedding hidden data in an audio signal, comprising the steps of:

receiving the audio signal in a base domain;

transforming the received audio signal to a linear prediction residue domain; and embedding the hidden data in the linear prediction residue domain via parametric representation of the audio signal by manipulating statistical mean of selected transform coefficients, and applying a scrambling technique to the transform coefficients with a scrambling filter kept as a secret key by a content owner.

18. The method of claim 17 further comprising the step of:

transforming the received audio signal to the linear prediction residue domain such that transform domain coefficients are generated that are indicative of the transformed audio signal.

19. The method of claim 18 further comprising the steps of:

manipulating a statistical measure of a selected subset of the transform domain coefficients in order to embed the hidden data.

20. The method of claim 19 further comprising the step of:

modulating the embedded data with at least one predetermined statistical feature of the transformed audio signal.

21. The method of claim 20 further comprising the step of:

increasing the amplitude of at least one predetermined feature of the transformed audio signal so that statistical mean of the predetermined feature is positive for embedding a bit of one in the audio signal.

22. The method of claim 17 further comprising the step of:

using a psycho-acoustic model to control inaudibility of the embedded data.

23. The method of claim 17 further comprising the steps of:

generating an inverse transformation signal using the embedded hidden data that is in the transformed audio signal;

receiving an attack upon the generated inverse transformation signal;

transforming the attacked inverse transformation signal to a non-base domain so as to generate a second transformed audio signal that is in the non-base domain; and extracting the embedded hidden data from the second transformed audio signal.

* * * * *